US008543016B2

(12) United States Patent
Nakajima

(10) Patent No.: US 8,543,016 B2
(45) Date of Patent: Sep. 24, 2013

(54) IMAGE FORMING APPARATUS AND IMAGE PROCESSING DEVICE

(75) Inventor: Takaharu Nakajima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 304 days.

(21) Appl. No.: 13/019,682

(22) Filed: Feb. 2, 2011

(65) Prior Publication Data

US 2012/0045227 A1 Feb. 23, 2012

(30) Foreign Application Priority Data

Aug. 23, 2010 (JP) ..... 2010-186451

(51) Int. Cl.
*G03G 15/08* (2006.01)

(52) U.S. Cl.
USPC ..... 399/27

(58) Field of Classification Search
USPC ..... 399/27, 28, 29, 54
See application file for complete search history.

(56) References Cited

U.S. PATENT DOCUMENTS 5,989,769 A * 11/1999 Mosher et al. ..... 430/115
2005/0219602 A1* 10/2005 Mikami ..... 358/1.14
2008/0124097 A1* 5/2008 Kong et al. ..... 399/27
2008/0317518 A1* 12/2008 Fukuhara ..... 399/302
2009/0123180 A1* 5/2009 Jackson et al. ..... 399/159

FOREIGN PATENT DOCUMENTS

JP A-8-152758 6/1996
JP A-2005-144828 6/2005

* cited by examiner

*Primary Examiner* — Walter L Lindsay, Jr.
*Assistant Examiner* — Rodney Bonnette
(74) *Attorney, Agent, or Firm* — Oliff & Berridge, PLC

(57) ABSTRACT

An image forming apparatus includes: an image information input section into which image information is input, and image holding members by which toner images of two or more colors including black and clear colors are held, respectively. The image forming apparatus further includes a transfer-receiving material to which toner of all colors are transferred from their respective image holding members, an image-area pinpointing section wherein an area of clear toner image to be superposed on a linear image region to be formed with toner of the black color is pinpointed in the image information input into the image information input section, and an image processing section wherein is performed replacement processing that at least part of black image on the pinpointed image area is formed with a hybrid of two or more kinds of colored toner instead of black toner.

16 Claims, 9 Drawing Sheets

IMAGE FORMING APPARATUS AND IMAGE PROCESSING DEVICE

CROSS-REFERENCE TO RELATED APPLICATION

This application is based on and claims priority under 35 USC 119 from Japanese Patent Application No. 2010-186451 filed on Aug. 23, 2010.

BACKGROUND

1. Technical Field

The present invention relates to image forming apparatus for forming a full-color image from toner images in different colors, and further to an image processing device to be mounted in such image forming apparatus.

2. Related Art

A lot of image forming apparatus for forming a full-color image from toner images in different colors has been widely known until now. As an example of the apparatus of such a type, there is image forming apparatus in which toner of a transparent color, or the so-called clear toner, is used for the purpose of enhancing e.g. glossiness and durability of printed images.

In order to present images in color of black, the image forming apparatus of such a type has often changed toner to use between black toner and process color black (PK) which is a colored toner mixture (superposing transfer composite) of cyan toner, magenta toner and yellow toner.

In such image forming apparatus, there are cases where black toner and clear toner are transferred to a transfer-receiving material, such as an intermediate transfer belt or a paper space, so that they are superposed upon each other at the surface of the transfer-receiving material. Such superposing transfer of black toner and clear toner has a problem that finally-obtained images tend to suffer the spreading of toner which is caused by toner scattering and referred to as blur. The blur of this type is conspicuous particularly in areas of small-width linear images, such as characters and drawings, and brings about degradation in image quality.

SUMMARY

Exemplary embodiments of the invention therefore aim to provide image forming apparatus which may inhibit toner from scattering, and further to provide an image processing device.

According to an aspect of the invention, an image forming apparatus includes:

an image information input section into which image information is input, image holding members by which toner images of two or more colors including black and clear colors are held, respectively, a transfer-receiving material to which toner of all colors are transferred from their respective image holding members, an image-area pinpointing section wherein an area of clear toner image to be superposed on a linear image region to be formed with toner of the black color is pinpointed in the image information input into the image information input section, and an image processing section wherein is performed replacement processing that at least part of black image on the pinpointed image area is formed with a hybrid of two or more kinds of colored toner instead of black toner.

BRIEF DESCRIPTION OF THE DRAWINGS

Exemplary embodiments of the invention will be described in detail based on the following figures, wherein.

DETAILED DESCRIPTION

Figure 1:
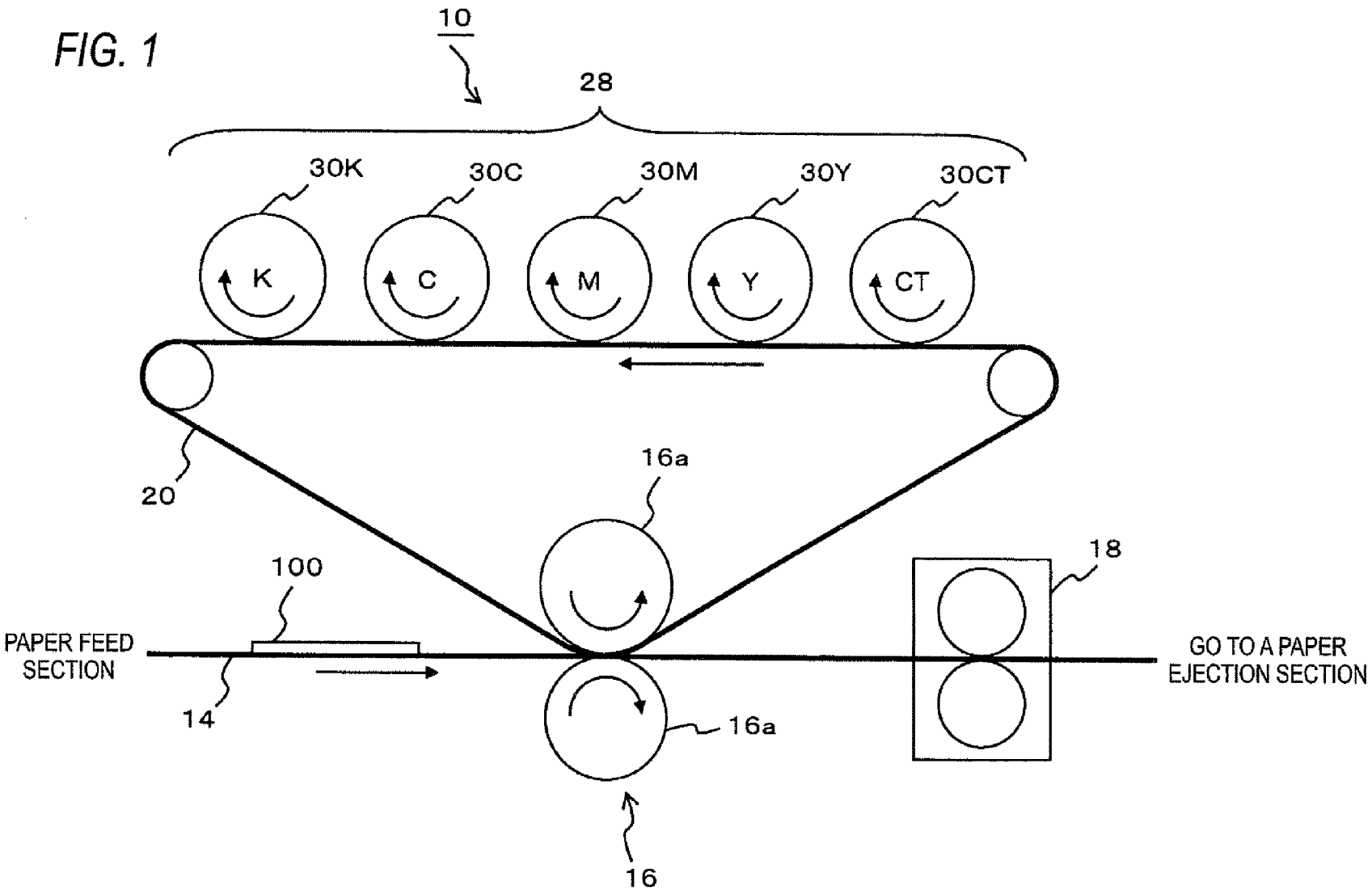
FIG. 1 is schematic diagram showing a configuration of image forming apparatus according to an exemplary embodiment of the invention.

Modes for carrying out the invention are illustrated below by reference to the drawings. FIG. 1 is a schematic configuration diagram of image forming apparatus 10 which is an exemplary embodiment of the invention. The image forming apparatus 10 is apparatus in which images are formed through the use of electrophotography, and it may be utilized by itself as a printer or it may be incorporated into a copier, a facsimile, a multifunction device or the like.

The image forming apparatus 10 is equipped with a paper feed section, a transfer section 16, a fixing section 18, a paper ejection section, a transport mechanism, an intermediate transfer belt 20, a print engine unit 28, a control section and so on. The paper feed section is piled with sheets to each of which printing is to be given, and feeds each of the sheets 100 in turn into the transport section in response to instructions from the control section. Additionally, the sheet 100 may be a sheet-type member to which printing is to be given, and thereto a cut sheet, cloth, an OHP sheet or the like is applicable.

The transport mechanism is a system for transporting each sheet 100 fed from the paper feed section to the downstream side, and provided with a conveyor belt 14 and transfer rollers. By means of the transport mechanism, the sheet 100 fed from the paper feed section is finally sent into the paper ejection section by way of the transfer section 16 and the fixing section 18. Although the transport mechanism of a type which sends each sheet 100 in one direction alone is exemplified herein, a circulation route by which each sheet 100 having been turned over after passage through the fixing section 18 is turned back to the upstream side of the transfer section 16 may be provided for the purpose of performing double-sided printing.

The transfer section 16 is provided with an intermediate transfer belt 20 and a pair of transfer rollers 16*a* which are placed on opposite sides of a conveyor belt 14. And each sheet 100 is transported into clearance between the pair of transfer rollers 16*a*, and thereby toner images formed on the intermediate transfer belt 20 are transferred to the sheet 100. The toner images transferred to the sheet 100 are heated and pressurized in the fixing section 18, and thereby they are fused and fixed to the sheet 100. Thus, the image printing on the sheet 100 reaches completion. The sheet 100 after the completion of image printing is sent to the paper ejection section and temporarily stored in a catch tray provided for the paper ejection section.

The intermediate transfer belt 20 is a belt to which toner images are transferred from photoreceptors installed in the print engine unit 28. In this exemplary embodiment of the invention, the intermediate transfer belt 20 is a transfer-receiving material to which toner images are to be transferred. The toner images having been transferred to the intermediate transfer belt 20 are transferred to each sheet 100 in the transfer section 16. On the upstream side from the transfer section 16 in the revolving direction of the intermediate transfer belt 20, five print engines 30CT, 30Y, 30M, 30C and 30K (hereinafter abbreviated merely as "print engines 30" by omitting their suffixed alphabets when there's no need to make distinctions among the five print engines) are provided, and the intermediate transfer belt 20 receives toner-image transfer from the photoreceptors installed in their respective print engines 30. Additionally, though it is provided in this exemplary embodiment of the invention, the intermediate transfer belt 20 may be omitted, and image forming apparatus may be configured so that toner images formed on their respective photoreceptors are transferred directly to each sheet 100. In this case, the sheet 100 is a transfer-receiving material to which toner images are to be transferred.

The print engine unit 28 is a unit which forms toner images according to images to be printed in practice and transfers the toner images to the intermediate transfer belt 20. This print engine unit 28 is the so-called tandem print-engine unit, and a plurality of print engines 30 provided for their respective kinds of toner are disposed along the intermediate transfer belt 20. In this exemplary embodiment of the invention, five kinds of toner, namely clear toner (CT), yellow toner (Y), magenta toner (M), cyan toner (C) and black toner (K), are used, and five print engines 30 are therefore disposed. Additionally, the clear toner is transparent color toner to be transferred in a state that it is superposed on other toner images for the purpose of improving glossiness and durability of the toner images.

Each print engine 30 forms a toner image of the color assigned thereto, and transfers the toner image formed to the intermediate transfer belt 20. The toner images of five kinds are transferred one after another to the intermediate transfer belt 20, and thereby a full-color toner image comes to be formed on the intermediate transfer belt 20.

Figure 2:
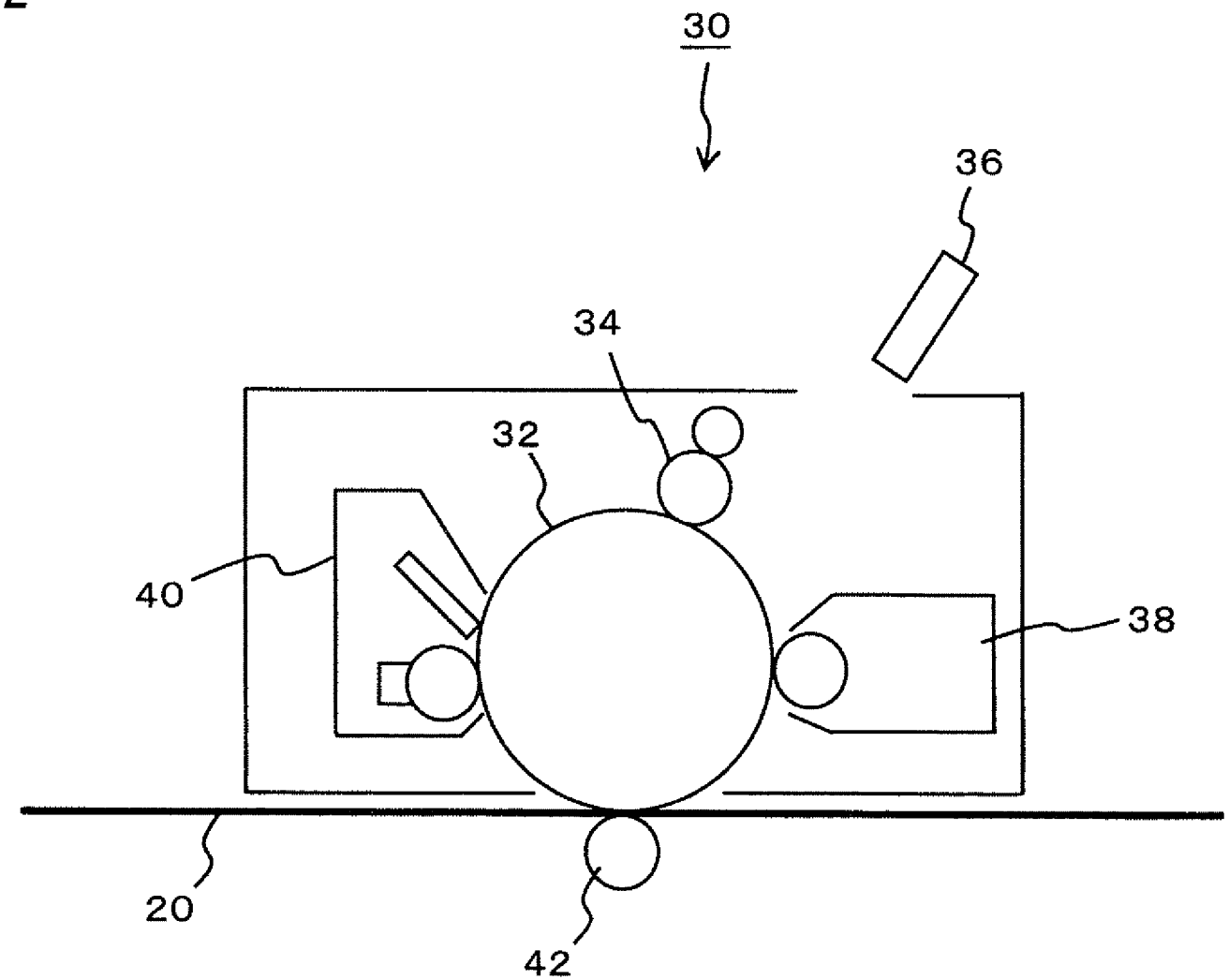
FIG. 2 is diagram showing a structure of a print engine.

All of the five print engines 30 have structures similar to one another. FIG. 2 is a schematic structure diagram of one print engine 30. This print engine 30 has a structure that a static electrification device 34, an exposure device 36, a developing device 38, a transfer roller 42 and a cleaning member 40 are arranged around the periphery of a photoreceptor 32. And the driving of these devices is controlled by a control section. The photoreceptor functions as an image holding member which holds a toner image formed of the toner assigned thereto. The static electrification device 34 electrifies the surface of the photoreceptor 32 until the potential of the surface reaches a predetermined value. The exposure device 36 selectively exposes the electrified surface of the photoreceptor to laser light, and thereby forms an electrostatic latent image responsive to the assigned toner color. The developing device 38 develops a toner image on the surface of the photoreceptor 32. This developing device accumulates toner, and the toner is electrified by agitation operation so as to have the polarity opposite to that of the photoreceptor surface. The toner electrified opposite in polarity is brought into the proximity of the photoreceptor's surface where the electrostatic latent image is formed, and thereby the toner is made to adhere to the photoreceptor's surface. Thus the toner image develops.

The toner image having developed on the photoreceptor 32 is transferred to the intermediate transfer belt 20 by means of the transfer roller 42. The transfer roller 42 faces the photoreceptor 32 via the intermediate transfer belt 20. The cleaning member 40 gives the photoreceptor a cleaning by elimination of toner remaining on the photoreceptor surface, and therein is included a blade-form or brush-form member which is in contact with the surface of the photoreceptor 32.

In this exemplary embodiment of the invention, five print engines 30 of the structure as mentioned above are arranged along the intermediate transfer belt 20. Additionally, as is clear from FIG. 1, the print engine for clear toner 30CT, the print engine for yellow toner 30Y, the print engine for magenta toner 30M, the print engine for cyan toner 30C and the print engine for black toner 30K are arranged in order of mention, viewed from the upstream side of the revolving direction of the intermediate transfer belt 20. In other words, transfer of each toner image to the intermediate transfer belt 20 is designed so that a clear toner image, a yellow toner image, a magenta toner image, a cyan toner image and a black toner image are transferred one after another in that order.

The control section exercises control over individual sections of the image forming apparatus 10. In addition, the control section also functions as an image processing device which calculates what toner images to form from printing image data input from a high-level device via an image information input section (not illustrated in FIG. 1). More specifically, when image printing is carried out, this control section makes color separation of image data under instructions for printing into image data for each of various colors, C, M, Y, K and CT, and instructs each of the print engines 30 to form a toner image of each individual color.

At this time, the control section carries out replacement processing, or processing of printing part of image areas under instructions for use of black toner in process color black (PK), which represents a black color by superposing cyan toner, magenta toner and yellow toner on top of each other, instead of black toner. In other words, the control section functions as an image-area pinpointing section wherein is pinpointed a black linear portion lying in a linear image area to be formed with black toner and undergoing image superposition using clear toner. In addition, the control section also functions as an image processing section which determines whether or not to form at least part of the thus pinpointed black linear portion with a hybrid of more than one kind of colored toner instead of black toner and, in the case of determining such formation, instructs the cyan print engine 30C, the magenta print engine 30M and the yellow print engine 30Y to form the toner images for formation of the black linear portion. The image processing section is described below in detail.

A black portion of an image is usually printed with black toner for the purpose of reducing usage of relatively high-priced toner, such as cyan toner, magenta toner or yellow toner, or enhancing reproducibility of black color. However, the use of black toner alone is likely to make the black portion poor in glossiness, and therefore there are cases where black toner and clear toner (namely colorless, transparent toner) are transferred to a transfer receiving material so that the black toner image and the clear toner image are superposed upon each other.

Figure 3:
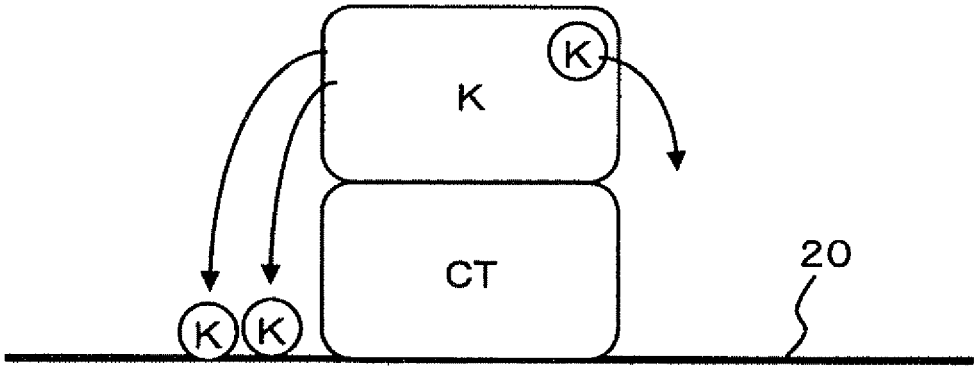
FIG. 3 is conceptual illustration showing superposing transfer of black toner and clear toner.

FIG. 3 is a conceptual illustration showing a complexion on superposing transfer of black toner and clear toner to the intermediate transfer belt 20 as a transfer receiving material.

In this exemplary embodiment of the invention, as described above, the print engine 30 for clear toner is situated upstream from the print engine 30 for black toner in the revolving direction, and thereby the clear toner image is transferred earlier than the black toner image is done, resulting in superposition of the transferred black toner image upon the transferred clear toner image.

When black toner and another toner are transferred in the superposed state as described above, toner spread referred to as blur occurs in some cases. A cause of the toner spread is attributable to incorporation of carbon into the black toner. By incorporation of carbon into the black toner, the black toner becomes susceptible to electric charge injection, and develops more toner particles bearing electric charges opposite to their original in polarity as compared with toner of another color. Further, such black toner is transferred later than every other toner, and thereby it is more likely to receive electric charge injection from a transfer nip. As a result, when the black toner and toner of another color are transferred to the transfer receiving material in a superposed state, electrostatic repulsion occurs among toner particles as shown in FIG. 3, and sometimes black toner particles fly off to positions different from normal ones. These black toner particles having flown off develop into toner spread referred to as blur to result in image quality degradation.

Figure 4:
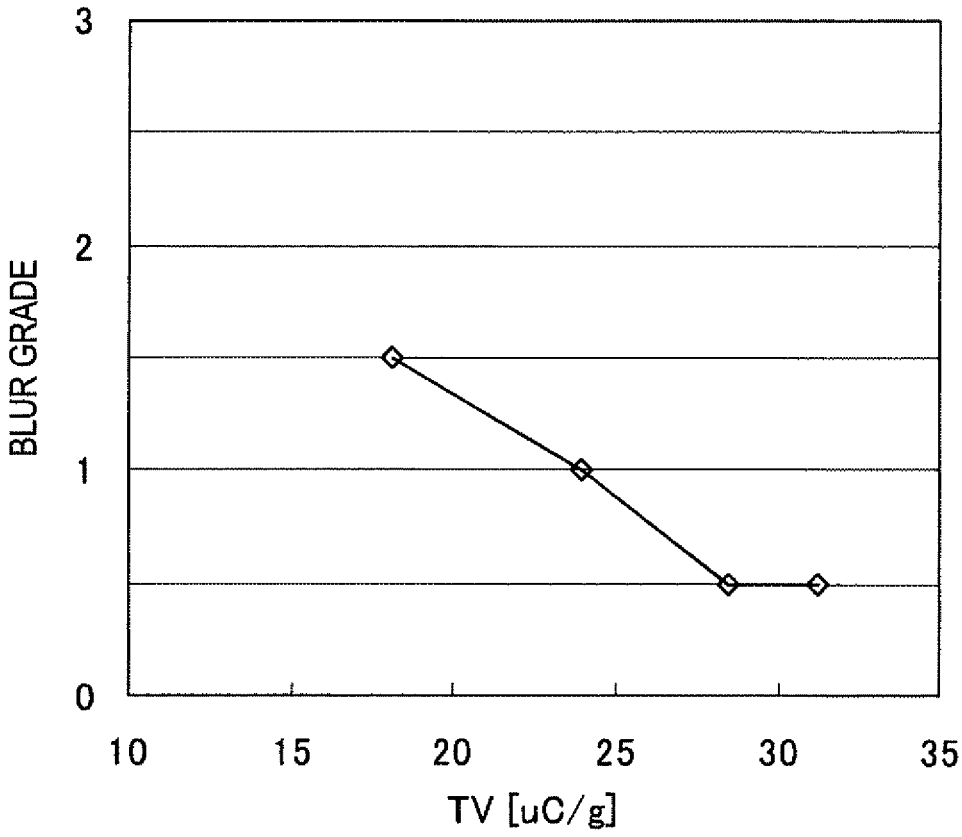
FIG. 4 is graph showing a relationship between ability of toner to be electrified and amount of blur occurrence.

FIG. 4 is a graph showing a relationship between the amount of electrostatic charge on toner and that of blur occurrence. In FIG. 4, the average amount of electrostatic charge (μC/g) on toner is plotted as abscissa and the amount of blur occurrence as ordinate. As may be clearly seen from FIG. 4, the smaller the amount of electrostatic charge (the more the toner particles electrified opposite in polarity), the more likely the blur to occur.

Figure 5:
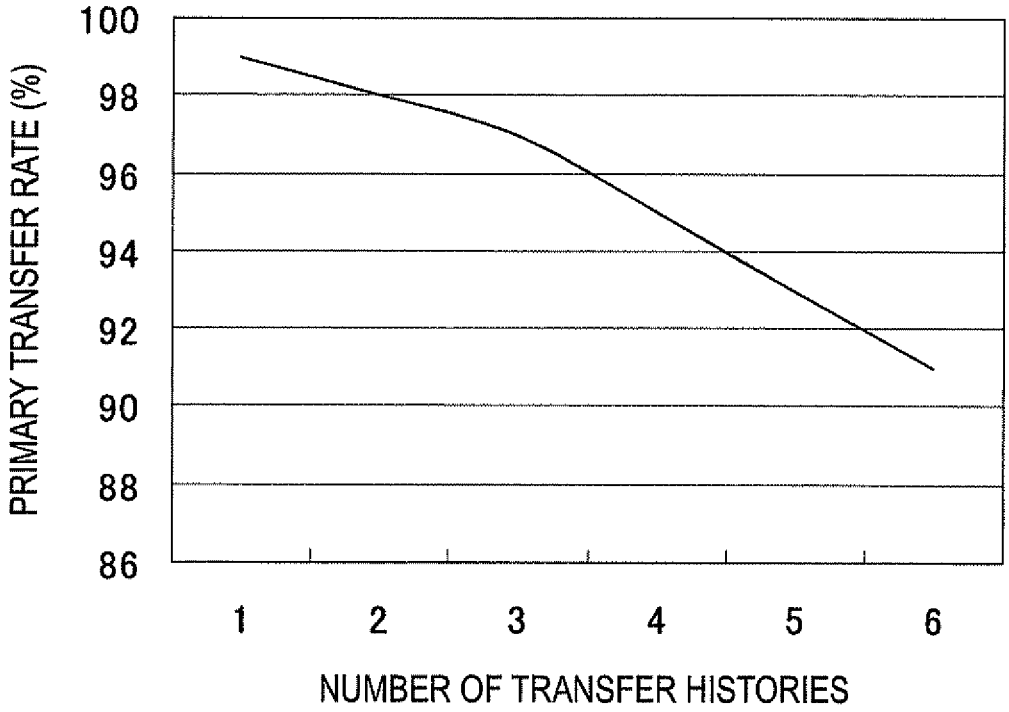
FIG. 5 is graph showing a relationship between number of transfer histories and transfer rate.

On the other hand, FIG. 5 is a graph showing a relationship between the number of transfer histories and the primary transfer rate. In FIG. 5, each number on the abscissa indicates the number of transfer histories (the number of times the intermediate transfer belt 20 has passed through the print engine 30) and that on the ordinate the primary transfer rate. By the way, the term "primary transfer rate" refers to the proportion of toner images having received primary transfer to the intermediate transfer belt to all the toner images formed on the photoreceptor. As may be clearly seen from FIG. 5, the greater the number of times the intermediate transfer belt has passed through the print engine 30, the lower the primary transfer rate. As a consequence, degradation in image quality is invited.

In view of these circumstances, according to this exemplary embodiment of the invention, the clear toner image-superposed portion of the linear image area to be formed of black toner is pinpointed for a black linear portion and at least part of the black linear portion is subjected to the replacement processing, thereby forming the part with a hybrid of more than one kind of colored toner instead of black toner. This replacement processing is illustrated below in detail.

Figure 6:
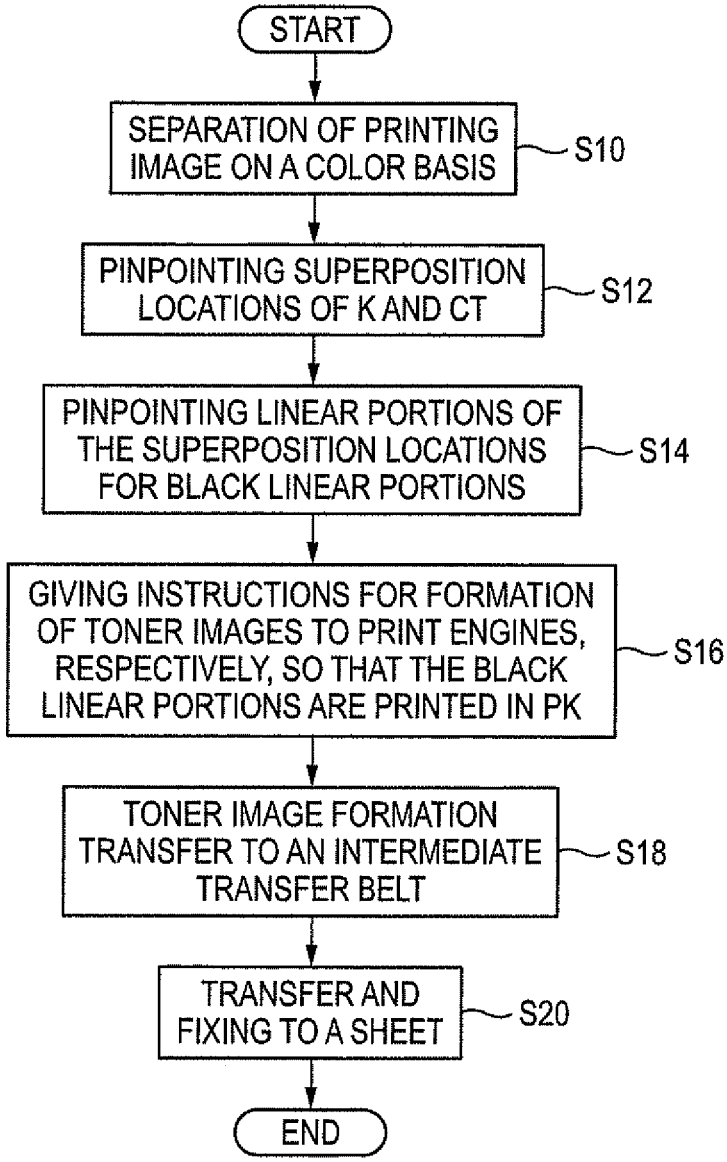
FIG. 6 is flowchart showing the flow of an image printing process.

FIG. 6 is a flowchart showing the flow of operations performed in image printing. Assume that image data for printing is input from a higher-level device, such as a control section of a personal computer or a copier, via an image information input section, and instructions for image printing are provided. In this case, the first operation the control section performs is color separation of the image data having taken an instruction for image printing into individual image data for each of colors C, M, Y, K and CT (S10). Subsequently to completion of the color separation, a comparison is drawn between black image data and image data for clear toner, and thereby superposed areas of both data are pinpointed (S12). These superposed areas may be said to be image portions specified so that transfer of the black toner and the clear toner to a transfer-receiving material (a surface of the intermediate transfer belt 20) is performed in a superposed state.

Then, a linear portion of the superposed area thus specified is pinpointed for a black linear portion (S14). The term "linear portion" as used herein refers to the image portion whose width is equal to or below a specified width. Although determination of the specified width depends on performance characteristics of image forming apparatus 10, properties of black toner and clear toner, the image quality required and so on, the specified width is basically set at, say, 2 mm, a width allowing blur to become inconspicuous even when black toner and clear toner are transferred in a superposed state.

When the black linear portion is pinpointed, the control section gives each of print engines 30 instructions for forming toner images so that the black linear portion is printed in process color black representing a black color through the superposing transfer of yellow toner, magenta toner and cyan toner (S16). In other words, the control section gives the yellow, magenta and cyan print engines 30 instructions for forming toner images in the black linear portion also.

Figure 7:
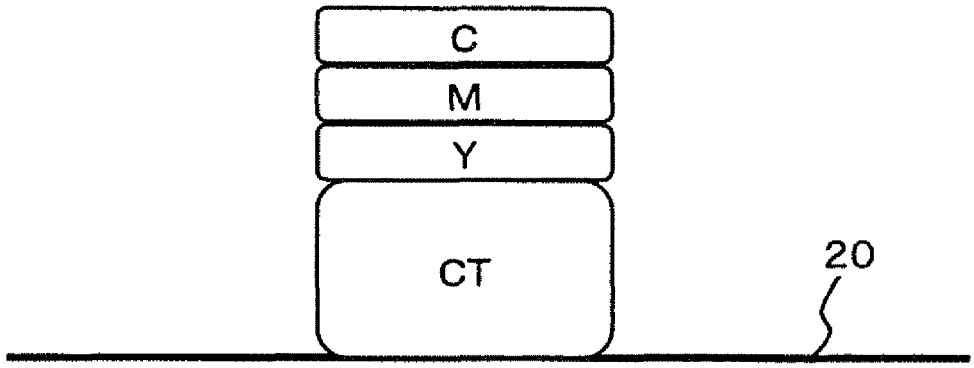
FIG. 7 is conceptual illustration showing a case of using process color black instead of black toner.

And according to these instructions, individual print engines 30 form toner images, and the toner images formed are transferred to the intermediate transfer belt 20 (S18). In this case, as shown in FIG. 7, clear toner, yellow toner, magenta toner and cyan toner are superposed in order of mention on an area which lies on the intermediate transfer belt 20 and corresponds to the black linear portion. Those kinds of toner are free of carbon which is likely to produce electric charge of opposite polarity, and therefore less prone to cause fly-off as already described.

In the case of process color black, each of yellow toner, magenta toner and cyan toner is transferred in the form of dots. More specifically, when a black color is represented by black toner, black toner particles are generally arranged without leaving any clearances among them, or equivalently, black areas are filled in with black toner. On the other hand, when a black color is represented by process color black, a toner image is formed in a condition that toner particles of one color are arranged so as to leave minute clearances among them in order that the three colors may be evenly dispersed, and toner particles of two other colors are arranged so as to fill the minute clearances. Because the toner image formed is an image in such a stippled state, there are clearances among toner particles, and pressure from the primary transfer nip is easily dispersed. Thus, the toner image comes to resist being affected by electric charge injection from the transfer nip. As a consequence, image quality degradation attributed to blur or the like comes to resist being caused. Finally, the full-color toner image transferred to the intermediate transfer belt 20 is further transferred to a sheet and then fixed, thereby completing the printing process (S20).

Figure 8A:
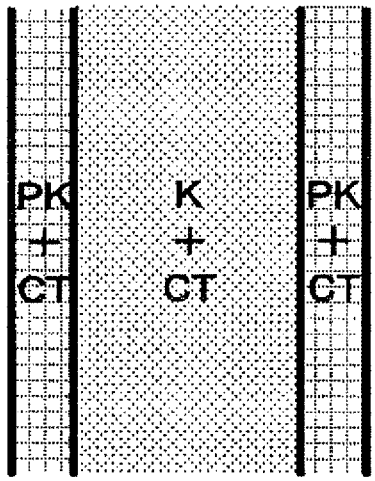
FIGS. 8A and SB are conceptual illustrations showing a style of another replacement processing.
Figure 8B:
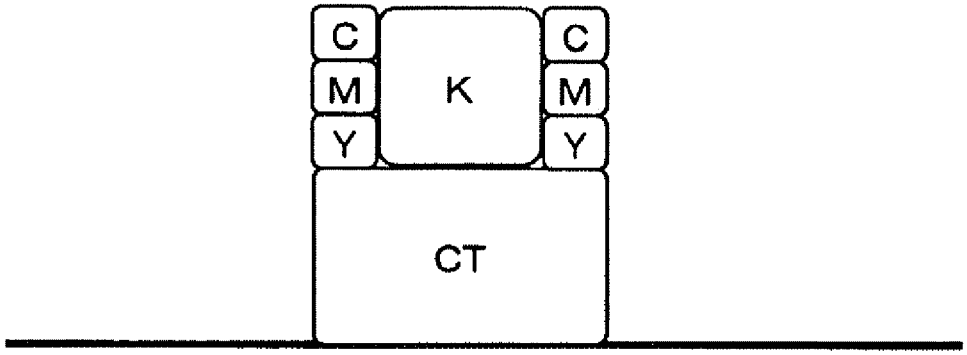

Additionally, in this exemplary embodiment of the invention, the whole black linear portion, which used to be a linear image portion wherein clear toner and black toner are superposed on each other, undergoes the replacement of black toner with process color black. However, not all the black linear portion is subjected to the replacement of black toner with process color black, but the replacement of black toner with process color black may be carried out in only part of the black linear portion. FIG. 8A is a conceptual top view of a toner image transferred to the intermediate transfer belt 20 under such partial replacement, and FIG. 8B is a conceptual sectional view of the toner image. As shown in FIGS. 8A and 8B, process color black resistant to blur is used only along the edge perimeter of the black linear portion, and thereby the edge of the black linear portion comes to resist being blurred on the one hand and, on the other hand, the use of black toner in the central part of the black linear portion enhances reproducibility of a black color. Thus, image quality is improved.

Figure 9:
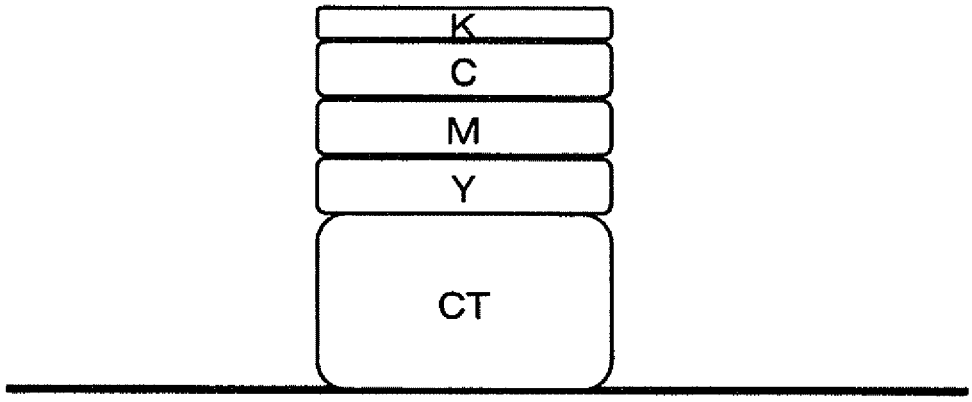
FIG. 9 is conceptual illustration showing a style of still another replacement processing.

In addition, the process color black may be presented in a composite form of four colors of Y, M, C and K, instead of three colors of Y, M and C. More specifically, as shown in FIG. 9, the black linear portion may be presented in a composite form of yellow toner, magenta color, cyan toner and black toner which are each transferred in a stippled state. Although black toner likely to cause blur is used, the usage thereof in such a case is reduced as compared with that in the case of representing a black color by black toner alone. As a consequence, the amount of black toner from which particles fly downward is also reduced, and the amount of blur occurrence becomes small. In contrast to the transfer of black toner which is only toner for representing a black color, the transfer of black toner as a constituent of such process color black is performed using the technique of stippling. Therefore the pressure at a primary transfer nip is dispersed, and effect of electric charge injection from the transfer nip is reduced. On the other hand, the use of black toner in combination with the three other colors of toner enhances reproducibility of black color. As a consequence, occurrence of blur is reduced, and besides, the reproducibility of black color is enhanced. Thus the image quality is more improved.

By the way, such replacement processing that black toner is replaced with process color black, though it may always be carried out, may be carried out in only cases where specified conditions are met. In other words, the replacement processing may be carried out in only cases where image quality degradation, such as blur, is assumed to tend to occur.

To be more specific, the replacement processing may be carried out e.g. only when the deterioration degree of black toner is estimated to be high. In this case, the control section estimates a deterioration degree of black toner from the using conditions of the toner, the electrification degree of the toner and so on, and whether or not the estimated deterioration degree is higher than a specified threshold value is determined. When the deterioration degree is found to be not lower than the specified threshold value, the replacement processing, namely the processing of pinpointing a linear image portion where black toner and clear toner are to be transferred in a superposed state and representing a black color of the image portion pinpointed by process color black, is carried out.

The using conditions of the toner subjected to deterioration degree determination include the number of days having lapsed since a toner change is carried out, the time having lapsed since the black toner is used last time, and the frequency of use of the toner. The frequency of use is defined by the amount of black toner used or the area of output dots with respect to the number of sheets used for printing with black toner or the driving hours of the print engine 30K after a toner change is carried out. The control section memorizes those values, and determines the deterioration degree on the basis of the values memorized.

Alternatively, electrification degree measurements on black toner may be made, and it may be inferred that the lower the electrification degree measured, the farther the deterioration of toner has gone. The electrification degree of toner may be determined by providing a sensor for measuring the amount of electrostatic charge and making the electrification degree measurement with the sensor, or from the amount or density of toner transferred to the intermediate transfer belt under conditions that the electric potential on the photoreceptor is kept constant. On the other hand, the deterioration degree may be determined on the basis of both the using conditions and the electrification degree, not either of them. In any of these ways, only when a finding that black toner suffers deterioration is made, the replacement processing is carried out, and thereby the usage of relatively expensive colored toner, such as cyan toner, magenta toner and yellow toner, may be reduced.

Further, whether or not to carry out the replacement processing may be determined on the basis of surrounding environment of the print engine 30. More specifically, when the temperature in areas surrounding the print engine 30 is too high or too low, blur tends to occur. As to the humidity also, unduly high or low humidity tends to become a cause of blur. Therefore the apparatus may be devised so as to perform the replacement processing when the temperature and humidity in areas surrounding the print engine 30 don't fall within the respectively specified ranges. In this case, the control section continuously or periodically monitors the temperature and humidity in areas surrounding the print engine 30 and performs comparisons with the respectively specified ranges.

Furthermore, whether or not the replacement processing is needed may be determined in response to the type of sheets to which printing is given. For instance, it is known that heavy-walled sheets are more likely to suffer image degradation, such as blur, than thin-walled sheets. This is because heavy-walled sheets are likely to receive higher nip pressure and to undergo more charge injection than thin-walled sheets. Therefore the apparatus may be devised so as to perform the replacement processing when the wall thickness of sheets fed from a sheet feed section is equal to or above a specified benchmark. In addition, whether or not the replacement processing is needed may be determined on the basis of not only the wall thickness of sheets but also the surface roughness and basis weight of sheets and the presence or absence of surface coatings on sheets. In any of these ways, when the sheets fed are those of the type which tend to cause blur, the replacement processing is carried out, and thereby the usage of relatively expensive colored toner, such as cyan toner, magenta toner and yellow toner, may be reduced. Moreover, whether or not the replacement processing is needed may be determined on the basis of synthetic assessment of at least two factors chosen from the deterioration degree of toner, the surrounding environment and the type of sheets. By making determination whether or not the replacement processing is needed on the basis of those two or more conditions, the timing in carrying out the replacement processing becomes better. And by carrying out the replacement processing only when image degradation could conceivably occur the usage of relatively expensive colored toner, such as cyan toner, magenta toner and yellow toner, may be reduced.

Although the case of image forming apparatus 10 equipped with a tandem print-engine unit 28 is taken in the foregoing description, the present image forming apparatus may have another structure as long as the structure allows formation of full-color images through transfer of toner images formed for each of different colors from an image holding member to a transfer-receiving material. For instance, the present image forming apparatus may be an image forming apparatus 10 equipped with the so-called cyclic print engine unit which forms full-color images by forming two or more kinds of toner images successively (repeatedly) on the surface of one photoreceptor (image holding member). In this case also, it is desirable that the linear image portion under an instruction from a higher-level device to receive superposing transfer of black toner and another toner be pinpointed for a black linear portion and the black linear portion be formed in process color black instead of black toner.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image forming apparatus comprising:

an image information input section into which image information is input, image holding members by which toner images of two or more colors including black and clear colors are held, respectively, a transfer-receiving material to which toner of all colors are transferred from their respective image holding members, an image-area identifier that identities an area of clear toner image to be superposed on a linear image region to be formed with toner of black color, and an image processing section that forms at least part of a black image on the identified area with two or more kinds of colored toner.

2. The image forming apparatus according to claim 1, wherein the two or more kinds of colored toner are independently formed in a stippled state, and laid one on top of another on the transfer-receiving material.

3. The image forming apparatus according to claim 1, wherein whether or not to carry out the replacement processing is determined on the basis of at least a deterioration degree of the black toner.

4. The image forming apparatus according to claim 3, wherein the deterioration degree of the black toner is predicted on the basis of at least one factor chosen from the amount of black toner used or the area of output dots with respect to the number of printed sheets or the driving hours of a developing device.

5. The image forming apparatus according to claim 3, wherein the deterioration degree of the black toner is predicted from the amount or density of toner formed on the image holding member or the transfer-receiving material under conditions that an electric potential on the image holding member is kept constant.

6. The image forming apparatus according to claim 1, wherein whether or not to carry out the replacement processing is determined on the basis of at least surrounding environment.

7. The image forming apparatus according to claim 1, wherein whether or not to carry out the replacement processing is determined on the basis of at least the type of sheets to which printing is given.

8. The image forming apparatus according to claim 1, wherein an edge portion of the black image on the pinpointed image area is formed with the hybrid of two or more kinds of colored toner and the remaining portion thereof is formed with black toner.

9. The image forming apparatus according to claim 1, wherein the two or more kinds of colored toner include black toner and colored toner of three colors, and the black toner and the colored toner of three colors are independently formed in a stippled state and laid one on top of another on the transfer-receiving material.

10. The image forming apparatus according to claim 1, further comprising: an image forming apparatus of tandem type wherein the image holding members are provided for toner of various kinds, respectively.

11. The image forming apparatus according to claim 1, wherein the black toner is transferred to the transfer-receiving material after the clear toner has been transferred.

12. The image forming apparatus according to claim 1, wherein the image-area identifier identifies the area of clear toner image to be superposed on the linear image region to be formed with toner of black color, the linear image region confined to an area whose width is equal to or less than a predetermined value.

13. The image forming apparatus according to claim 1, wherein the image-area identifier identifies the area of clear toner image to be superposed on the linear image region to be formed with toner of black color prior to printing.

14. An image processing device comprising:

an image information input section into which image information to form through superposing transfer of toner images of two or more colors including black and clear colors to a transfer-receiving material is input, an image-area identifier that identifies an area of clear toner image to be superposed on a linear image region to be formed with toner of black color, and an image processing section that forms at least part of a black image on the identified area with two or more kinds of colored toner.

15. The image processing device according to claim 14, wherein the image-area identifier identifies the area of clear toner image to be superposed on the linear image region to be formed with toner of black color, the linear image region confined to an area whose width is equal to or less than a predetermined value.

16. The image processing device according to claim 14, wherein the image-area identifier identifies the area of clear toner image to be superposed on the linear image region to be formed with toner of black color prior to printing.

* * * * *